US011189255B2

(12) United States Patent
Gorman et al.

(10) Patent No.: US 11,189,255 B2
(45) Date of Patent: Nov. 30, 2021

(54) FILM FORMED SNARE AND REDUCED VOLUME SNARE DRUMHEAD

(71) Applicant: D'Addario & Company, Inc., Farmingdale, NY (US)

(72) Inventors: Ryan Gorman, Farmingdale, NY (US); Paul Pearl, Melville, NY (US); Tyler Burke, Wantagh, NY (US); Richard Stillwell, Melville, NY (US); Sergio Bonsignore, Ridgewood, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 17/024,782

(22) Filed: Sep. 18, 2020

(65) Prior Publication Data

US 2021/0090531 A1 Mar. 25, 2021

Related U.S. Application Data

(60) Provisional application No. 63/019,585, filed on May 4, 2020, provisional application No. 62/902,425, filed on Sep. 19, 2019.

(51) Int. Cl.

| | |
|---|---|
| ***G10D 13/18*** | (2020.01) |
| ***G10D 13/24*** | (2020.01) |
| ***G10D 13/02*** | (2020.01) |

(52) U.S. Cl.

CPC ..... *G10D 13/18* (2020.02); *G10D 13/02* (2013.01); *G10D 13/24* (2020.02)

(58) Field of Classification Search

None

See application file for complete search history.

(56) References Cited

U.S. PATENT DOCUMENTS

| | | | | |
|---|---|---|---|---|
| 1,654,592 A * | 1/1928 | Lockwood | ..... | G10D 13/02 84/411 R |
| 4,095,505 A * | 6/1978 | Hoey | ..... | G10D 13/02 84/416 |
| 4,254,685 A * | 3/1981 | Rose | ..... | G10D 13/02 84/414 |
| 4,325,281 A * | 4/1982 | Hardy | ..... | G10D 13/02 84/411 M |

(Continued)

OTHER PUBLICATIONS

"Evans Hazy 300 Snare Drum Heads," retrieved from: https://www drumshack.co.uk/evans-hazy-300-snare-drum-heads/p/2020 on Mar. 13, 2019.

(Continued)

*Primary Examiner* — Robert W Horn

(74) *Attorney, Agent, or Firm* — Alix, Yale & Ristas, LLP

(57) ABSTRACT

A snare unit formed from film material includes a plurality of slots that define segments. The snare unit is attachable relative to a drumhead with a surface of the film flat against a surface of the drumhead. In the attached position, one or more of the segments vibrates against the drumhead when the drumhead is struck to produce a snare-like audible sound. In a drumhead with reduced volume, the snare unit is positioned flat against one or more layers of a porous material to define a drumhead and attached such that a portion of the snare unit vibrates against a surface of the porous material when the drumhead is struck, thereby producing a snare-like sound having a volume reduced relative to a standard drumhead.

20 Claims, 6 Drawing Sheets

(56) References Cited

U.S. PATENT DOCUMENTS

| | | | | |
|---|---|---|---|---|
| 4,706,540 | A * | 11/1987 | Donohoe | G10D 13/20 84/414 |
| 4,798,121 | A * | 1/1989 | Donohoe | G10D 13/02 84/414 |
| 5,204,484 | A | 4/1993 | Netto | |
| 5,493,942 | A * | 2/1996 | Wolf | G10D 13/02 84/411 R |
| 5,892,168 | A * | 4/1999 | Donohoe | G10D 13/02 84/411 M |
| 5,920,021 | A * | 7/1999 | Good | G10D 13/02 84/411 M |
| 6,184,451 | B1 | 2/2001 | Miller et al. | |
| 6,215,053 | B1 | 4/2001 | Adinolfi | |
| 6,245,979 | B1 | 6/2001 | Campbell | |
| 6,291,753 | B1 * | 9/2001 | Campbell | G10D 13/10 84/411 M |
| 6,518,490 | B2 * | 2/2003 | Good | G10D 13/02 84/414 |
| 6,849,793 | B2 | 2/2005 | Okamoto et al. | |
| 6,867,355 | B2 | 3/2005 | Okamoto | |
| 7,199,297 | B2 | 4/2007 | Anderson | |
| 7,202,405 | B2 | 4/2007 | Takegawa | |
| 7,214,867 | B1 * | 5/2007 | Gatzen | G10D 13/02 84/411 R |
| 7,495,159 | B1 | 2/2009 | Takegawa et al. | |
| 7,649,132 | B2 | 1/2010 | Nickel | |
| 7,741,550 | B2 | 6/2010 | Miyajima | |
| 7,932,452 | B2 * | 4/2011 | Chen | G10D 13/20 84/411 R |
| 8,148,619 | B1 * | 4/2012 | May | G10D 13/14 84/411 M |
| 8,933,311 | B2 * | 1/2015 | Hashimoto | G10D 13/10 84/411 R |
| 9,257,107 | B1 * | 2/2016 | Belli | G10D 13/10 |
| 9,396,712 | B1 * | 7/2016 | Dunnett | G10D 13/20 |
| 9,626,945 | B2 | 4/2017 | Lowery | |
| 9,959,849 | B2 | 5/2018 | Abe et al. | |
| 10,388,262 | B2 * | 8/2019 | Zhong | G10D 13/20 |
| 10,621,960 | B2 * | 4/2020 | Hubbert | G10D 13/02 |
| 2004/0031375 | A1 | 2/2004 | Hayden, III | |
| 2005/0200059 | A1 | 9/2005 | Smith et al. | |
| 2019/0295516 | A1 * | 9/2019 | Hashimoto | G10D 13/00 |
| 2021/0090531 | A1 * | 3/2021 | Gorman | G10D 13/18 |

OTHER PUBLICATIONS

"Evans Xtreme Patch—Marching Snare Drum Head," retrieved from: https://www.interstatemusic.com/100084-Evans-Xtreme-Patch-Marching-Snare-Drum-Head-EMAXP.aspx on Mar. 13, 2019.

* cited by examiner

FILM FORMED SNARE AND REDUCED VOLUME SNARE DRUMHEAD

CROSS-REFERENCE TO RELATED APPLICATIONS

This application claims priority to U.S. Provisional Application No. 62/902,425 for Snare Drumhead with Reduced Volume, filed on Sep. 19, 2019, and to U.S. Provisional Application No. 63/019,585 for Film Formed Snare for Drum, filed on May 4, 2020, the entire contents of which are incorporated by reference herein.

BACKGROUND

The disclosed embodiments relate to snare drums, and in particular to a snare unit formed by film that is mountable to a drum for producing snare sounds. The disclosure additionally relates to a snare drum assembly that produces a snare sound with reduced volume compared to standard snare drums A snare drum is a drum that is distinctive both in function and design. The most basic characteristic of a snare drum is that it has a bottom end configured for engagement with a snare unit for optional intimate contact between snares and a lower vibrating drumhead. The vibrating contact between the snares and the lower drumhead produce a distinctive sound common to snare drums.

Snare assemblies are typically formed of coiled steel or other metal, nylon cable or animal gut extended laterally between opposite end plates or other attachment units. All of these materials carry drawbacks, including high initial cost, heavy weight and susceptibility to corrosion and moisture damage. Additionally, known snare assemblies can be laborious and complicated to manufacture given the challenges of reliably mechanically attaching the separate snare segments and the other hardware. Known snare mounting assemblies and techniques carry drawbacks, including difficulties in attachment. Attaching snare assemblies via straps to the strainer and/or butt end can be cumbersome and time consuming, and often requires tools like a screwdriver or drum key to release and tightening to a preferred tension. Additionally, many known snare assemblies carry a drawback in that tightening of the straps tilts the end plate in a direction that actually pulls the snares upward away from the drumhead at the edges, which can cause sympathetic vibrational sounds such as extraneous buzzing, such as, for example when an adjacent drum is stricken.

A common or "standard" snare drum produces a sound at full volume, typically above 100 dBA. Having recognized issues with full volume, the industry has developed snare drums that are considered "low volume," essentially for use only in practice settings. These low volume snare drums are too low in volume and typically do not provide a natural snare sound or adequate mimicking of a snare sound, and are thus not applicable to use in performance settings.

There are many settings or situations in which drummers desire the sound of their snare drums at a reduced volume, lower than standard volume, but more audible than low volume and suitable for performance settings, while not sacrificing a natural snare sound.

It would thus be useful to have an alternate snare unit that cures the drawbacks associated with known snare units. For example, a snare unit that is low cost, durable, lightweight, easily transportable, and resistant to moisture or other weather-related corrosive conditions. It would also be useful to have an alternate snare drum or drumhead assembly that cures the drawbacks associated with low volume drumheads and which eliminates or reduces sympathetic snare responses caused by vibrating tensions between various drums on a drum.

SUMMARY

In one embodiment, a drumhead comprises a layer of porous material and a layer of film material. The layer of porous material defines a top surface and bottom surface. The layer of film material defines a surface in surface-to-surface contact with one of the top surface or bottom surface of the layer of porous material and is configured and attached to the drumhead such that a portion of the film material vibrates against the porous material when the drumhead is struck, thereby producing a snare-like sound.

In another embodiment, a snare unit for use with a drumhead comprises a substantially flat sheet of film material with a top surface and opposite bottom surface. The sheet of film material further comprises a snare section with a plurality of slots from the top surface to the bottom surface. The slots are spaced from one another to form a plurality of snare segments between adjacent slots. The flat sheet of film material is connectable relative to the drumhead in a position with the top surface or bottom surface flat against a resonating surface of the drumhead such that one or more of the segments vibrates against the resonating surface when the drumhead is struck, thereby producing a snare-like sound.

In yet another embodiment, a drumhead comprises a layer of a porous material and a layer of a film material. The layer of porous material defines a top surface and bottom surface. The layer of film material defines a surface in surface-to-surface contact with one of the top surface or bottom surface of the layer of porous material. At least a portion of the layer of film material has segments separated from one another by slots. The layer of layer of film material is secured to the layer of porous material at an area of the layer of film material removed from the segments, such that the segments are configured to vibrate freely against the layer of porous material when the drumhead is struck, thereby producing a snare-like sound.

BRIEF DESCRIPTION OF THE DRAWINGS

Aspects of the preferred embodiment will be described with reference to the Drawings, where like numerals reflect like elements throughout.

DISCLOSURE OF THE INVENTION

Among the benefits and improvements disclosed herein, other objects and advantages of the disclosed embodiments will become apparent from the following wherein like numerals represent like parts throughout the several figures. Detailed embodiments of a film formed snare unit and reduced volume snare drumhead assembly are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

Figure 1:
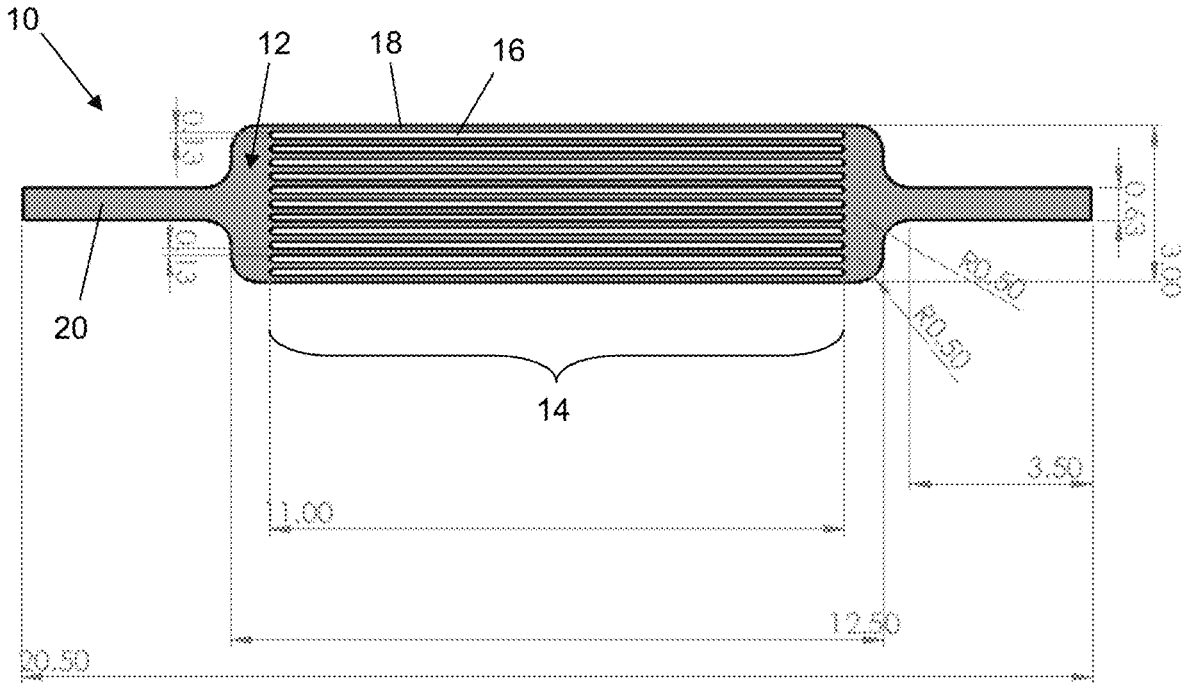
FIG. 1 shows an embodiment of a film formed snare unit in accordance with the disclosure.
Figure 2:
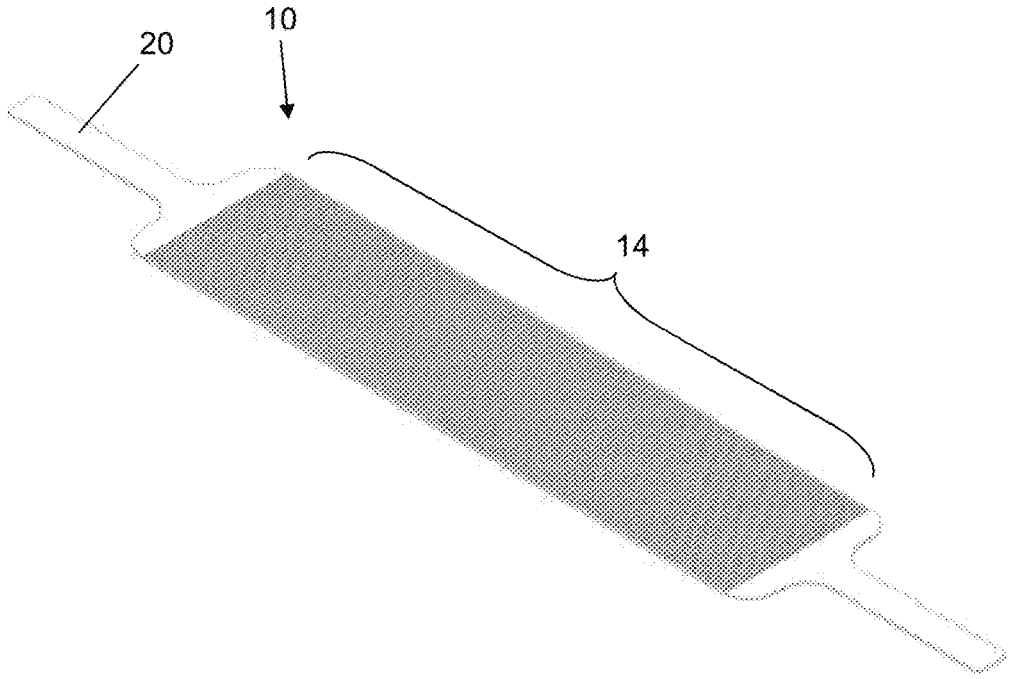
FIG. 2 shows another embodiment of the film formed snare unit.
Figure 3:
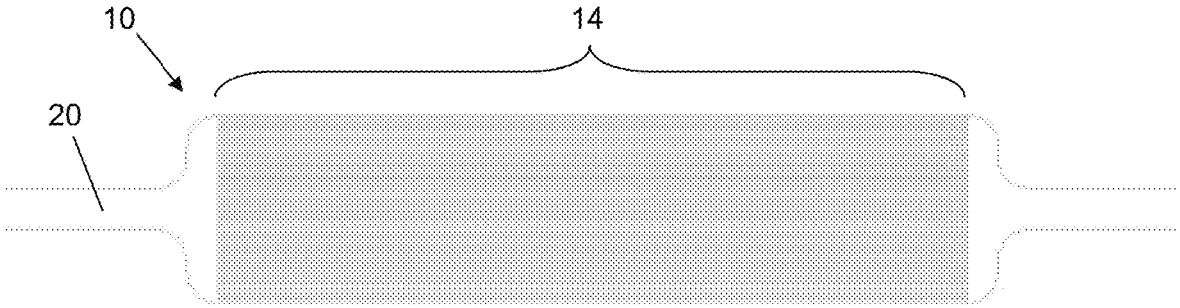
FIG. 3 shows a top perspective view of the film formed snare unit of FIG. 2.

Disclosed herein is a snare unit 10 that is formed from a single sheet of a film material 12 cut into a predetermined shape and configuration. As shown most clearly in FIG. 1, the snare unit 10 includes a central or intermediate snare section 14 with a plurality of elongate laterally extending parallel slits or slots 16 spaced apart from one another, which form snare segments 18 between successive spaced apart slots. The snare unit 10 can also include attachment sections 20 on opposite lateral ends. The attachment sections shown in the drawings are exemplary, and non-limiting to the inventive concepts and structure of the snare unit 10. For instance, the attachment sections 20 can come in any number of different configurations for assisting attachment at the bottom of a drum, like that depicted in FIG. 4 as reference numeral 22. For instance, the attachment sections may include holes, slots or hooks cut into the film 12 and/or may include additional hardware or features incorporated into them for assisting secure attachment to a drum. FIG. 1 also shows preferred dimensions of the embodiment of the snare unit 10.

In a preferred manufacturing technique, a flat sheet of film material 12 is laser cut to the desired specifications, such as the exemplary dimensions shown in FIG. 1. Another method of making the snare unit 10 is via die cutting of an appropriate film 12. The film material can be made from the same material as a standard drum membrane, such as Kevlar® or Mylar® branded polymers, polyesters, aramids or other polymeric materials. As shown in FIGS. 1-4, in one embodiment, the film 12 is substantially flat and cut to a shape with narrow attachment sections 20 on each of the lateral ends which transition to a wider central snare section 14. The snare section includes a plurality of laterally extending snare segments 18 formed via a series of elongate spaced apart slots 16. The snare segments 18 in the embodiment of FIGS. 1-4 are configured to mimic common snare segments made from metal, gut or nylon to provide similar vibrational and acoustic characteristics when positioned in contact with a lower drumhead.

Figure 5:
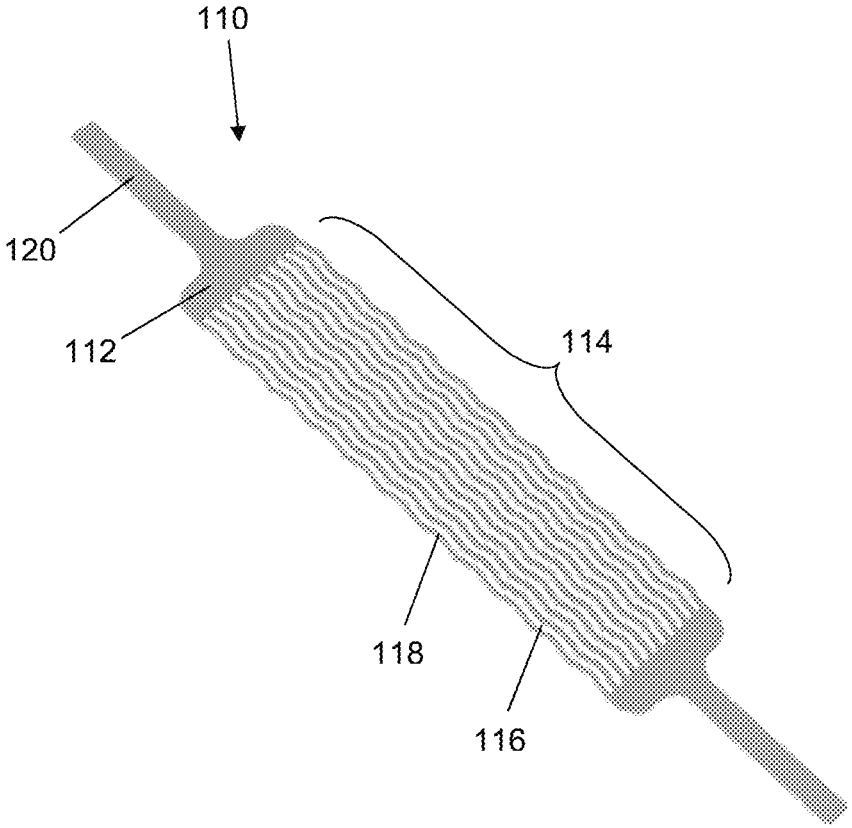
FIG. 5 shows an embodiment of the film formed snare unit with corrugated snare segments.

The exact dimensions and other configurations of the snare unit 10 can be adjusted as desired for different sized drums or to effect different acoustic properties. FIG. 5 shows another embodiment of a snare unit 100 with corrugated or waved snare segments 118. Embodiments exist in which snare segments 18 and/or slots 16 are varied in size, shape, thickness and/or distance between each other. Embodiments exist wherein the film layer substantially commensurate in peripheral shape to the associated drumhead with slots and segments in locations such as that shown as reference numeral 314 in FIGS. 6-10B. In a sense, the disclosed film formed snare unit 10 can easily be altered in any number of ways simply by varying the laser or die cutting programming. Appropriate coatings for altering acoustic tone of the otherwise uncoated film may be applied to the outer surfaces of the cut snare unit 10 after formation or applied to the entire sheet of film material prior to cutting the snare unit 10. Coatings can be applied via a variety of processes such as, for example screen printing, UV cured and/or spray.

Figure 4:
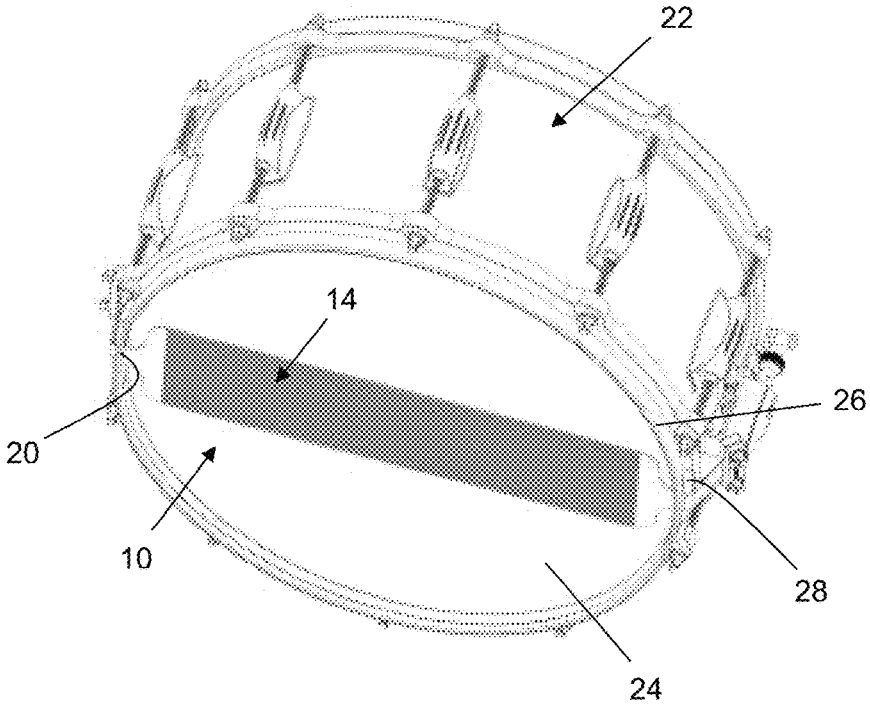
FIG. 4 shows the disclosed film formed snare unit attached to a standard drumhead.

FIG. 4 shows a snare unit 10 attached to a standard drum 22 in a traditional snare position extending across the diameter and positioned against the lower drumhead 24. As shown, the drum 22 includes a lower frame with openings 28 on opposite sides approximately 180° from one another through which the attachment sections 20 can extend to be secured via hardware 30. The attachment mechanism shown in FIG. 4 is merely exemplary and clearly non-limiting of the inventive aspects of the snare unit 10.

When attached to a drum 22 in contact with the lower drumhead 24, as shown in FIG. 4, the disclosed snare unit 10 has displayed excellent acoustic properties that closely emulate the sound of snares formed by metal, nylon and/or gut with acceptable and often exemplary sound quality. Since the snare unit 10 is formed of a polymeric material, it is not susceptible to degradation over time by environmental conditions such as moisture or oxidation. Further, due to the simplicity of the single-piece cut snare unit and the associated manufacturing process, and moderate cost of materials as compared to known snare assemblies, the disclosed snare unit 10 is inexpensive to manufacture relative to known snare assemblies.

Additionally, while the above embodiments of the snare unit 10 and 100 are described with reference to attachment to a standard drum 22 with a film drumhead, the snare unit 10 and 100 can be installed on a variety of different types of drumheads. For example, in another preferred embodiment, a film snare unit is installed on in contact with a porous material (mesh or similar) commonly used to form a reduced-volume drumhead.

Additionally, embodiments exist wherein a layer of a film snare unit is attached directly to a portion of a drumhead in a manner that allows vibration between parts of the film snare and the drumhead. In this manner the film snare unit or assembly forms part of an integral snare drumhead. For example, shown in FIGS. 6-10 are embodiments of a snare drumhead assembly and elements thereof. At its most basic, the drumhead assembly 200 comprises a layer of a porous material 212, such mesh, and a ply of a slotted film material 214. In this embodiment, it can be seen that the film "snare" layer 214 diverges in shape and configuration from that shown in FIGS. 1-5. The porous layer 212 is circular in shape and is stretched across a standard circular hoop 220, as is common in the drumming arts.

Figure 6:
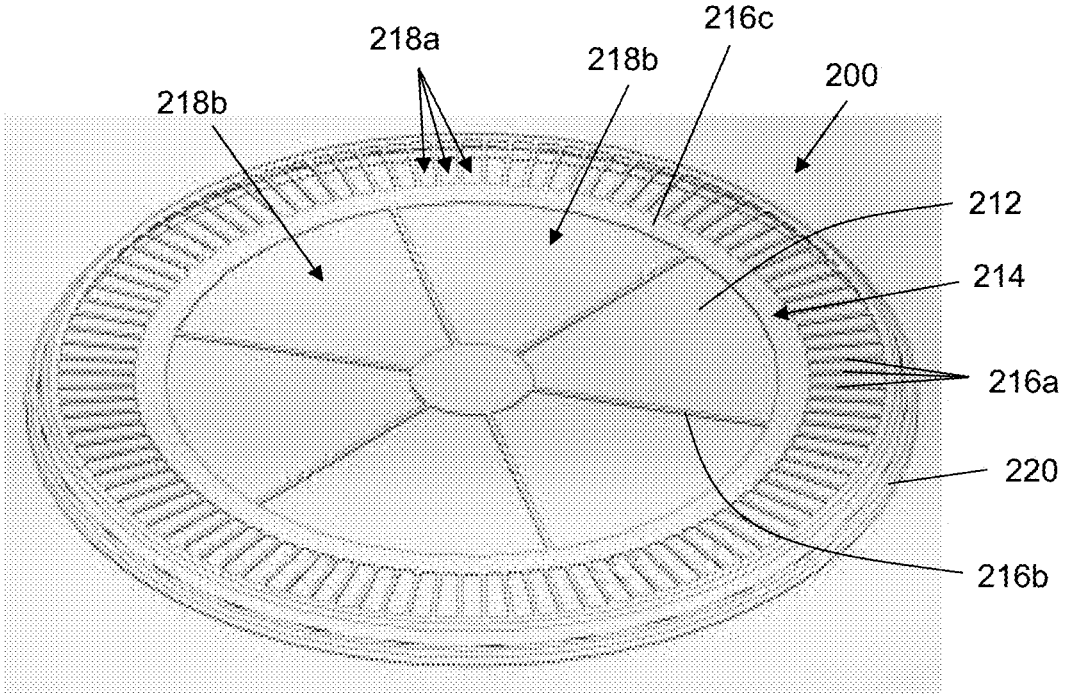
FIG. 6 shows an embodiment of a snare drumhead with reduced volume formed by a porous mesh layer and a film snare layer.
Figure 7:
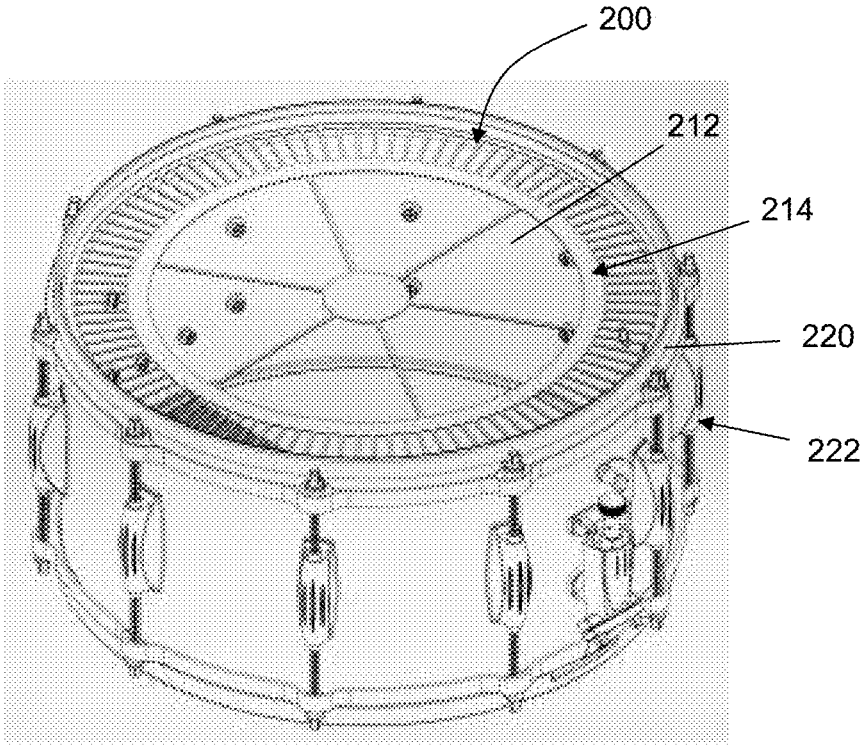
FIG. 7 shows the drumhead of FIG. 6 installed on a drum.

The film layer 214 is formed from a polymeric material, like the snare unit 10 described above, with a series of slots, holes and/or openings 218 defining strands or segments 216 therebetween. The configuration of the segments 216 and slots 218 formed in the film layer depicted in FIG. 6 is non-limiting. However, the configuration of the film layer in all embodiments is generally such that it promotes vibration of the film layer 214 (especially the segments 216) against the porous layer 212 to produce a snare-like audible response. In the depicted embodiment of FIGS. 6 and 7, the film layer 214 includes a series of outer slots 218*a* and segments 216*a* that circumscribe the outer edge of the drumhead 210. A series of larger openings 218*b* define radially inner segments 216*b* that are spaced from one another a greater distance than the outer segments 216*a*. This configuration also defines an inner ring 216*c* intermediate the other segments 216*a* and inner segments 216*b*.

Figure 8:
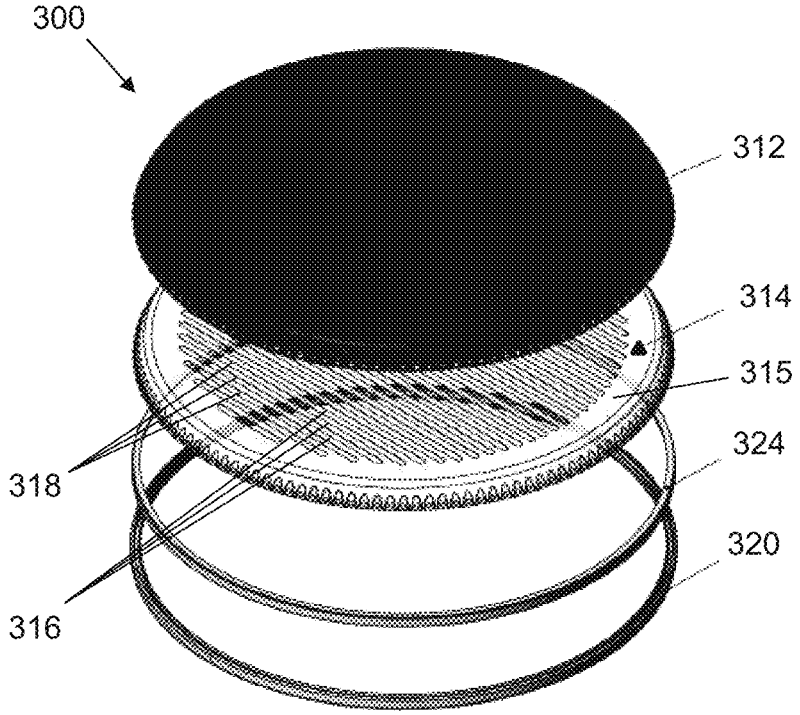
FIG. 8 is an exploded view of another embodiment of a snare drumhead with reduced volume utilizing a film snare layer.

FIG. 8 depicts an embodiment of the drumhead assembly 300 with a film layer 314 having an alternate configuration. This film layer 314 has an outer circumference substantially equal to that of the porous layer 312. As shown, the snare film layer 314 is provided with a series of substantially parallel segments 316 spaced apart via slots 318 along its surface and defines a solid outer circumferential section 315.

Figure 9:
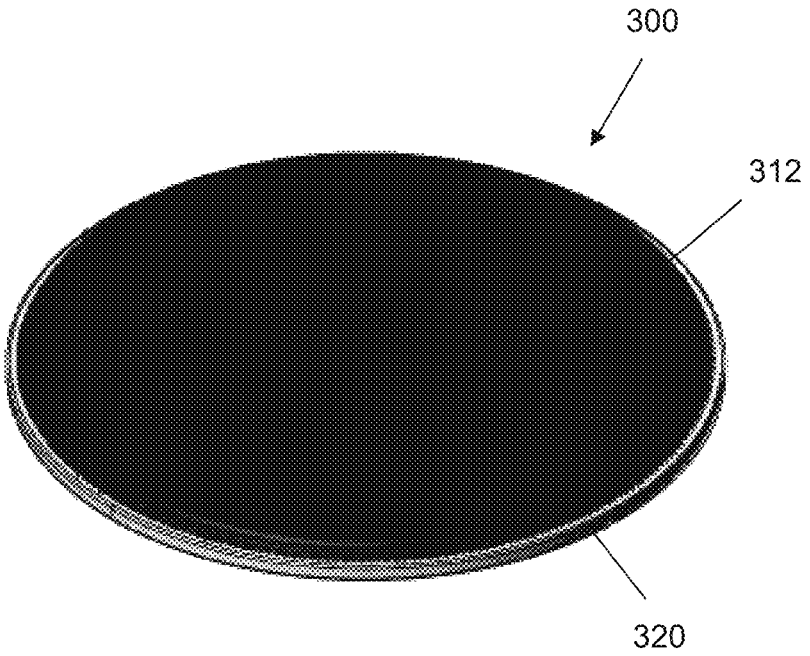
FIG. 9 shows the drumhead of FIG. 8 in its assembled configuration with film snare layer beneath a porous mesh layer.

With reference to the exploded view of FIG. 8, the film layer 314 is secured to the porous layer 312 and the hoop 320 via adhesive 324 (preferably epoxy-based) along the outer peripheral edge. Alternative or additional means of attachment between two or more of the porous layer 312, film layer 314 and hoop 320 include all known methods of mechanical attachment. For example, in one alternate embodiment, both the porous layer 312 and film layer 314 are crimp locked with the hoop 320 without use of adhesive. Joining the film layer 314 to the drumhead 300 only along its outer peripheral edge in this manner allows a substantial amount of vibration between the film layer 314, particularly the segments 316, and the porous layer 312 when the drumhead is struck. As shown in FIG. 9, when the drumhead 300 is assembled, the film layer 314 is concealed beneath the porous layer 312 that serves as the striking surface of the drumhead assembly 300. Other embodiments may include multiple layers of porous material and/or film, or may include a composite porous layer.

In this embodiment, the elongate segments 316 extend parallel with one another and are spaced apart along almost the entire circular surface of the film layer 314. A solid outer annular ring 315 is present around the inner section that includes the slots 318 and segments. While this configuration is preferred for most drumhead assemblies 300, it is nonlimiting in that other embodiments exist wherein the segments are concentrated in a more confined area of the film layer, such as proximate the diameter (similar to known snares extending across the diameter of a drumhead and/or the embodiment of the film formed snare unit 10).

Figure 10A:
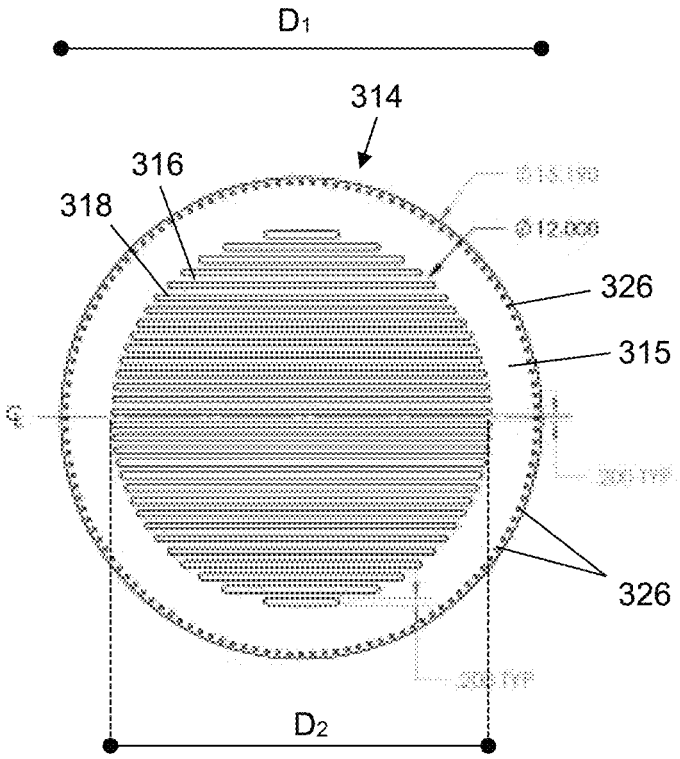
FIG. 10A is top view of an exemplary film snare layer for use within the drumhead of FIGS. 8 and 9 prior to installation in the drumhead assembly.

FIG. 10A is a top view of a film layer 314 used within a drumhead assembly like that of FIG. 8 in isolation prior to incorporation into the drumhead and showing exemplary preferred dimensions. The specific depicted film layer 14 in FIG. 10 is for incorporation into a 14-inch drumhead. As shown, prior to installation into the drumhead assembly, the outer diameter is approximately 15.2 inches. In this embodiment, the slots 318 that define the segments 316 in the film layer 314 extend parallel to one another along a central circular inner section approximately 12 inches in diameter. The slots 318 and segments 316 are equal in thickness, in the depicted embodiment approximately 0.2 inches thick. A plurality of attachment holes 326 are punched or cut along the outer circumferential edge for aiding attachment to the hoop 320 and/or porous layer 312.

Figure 10B:
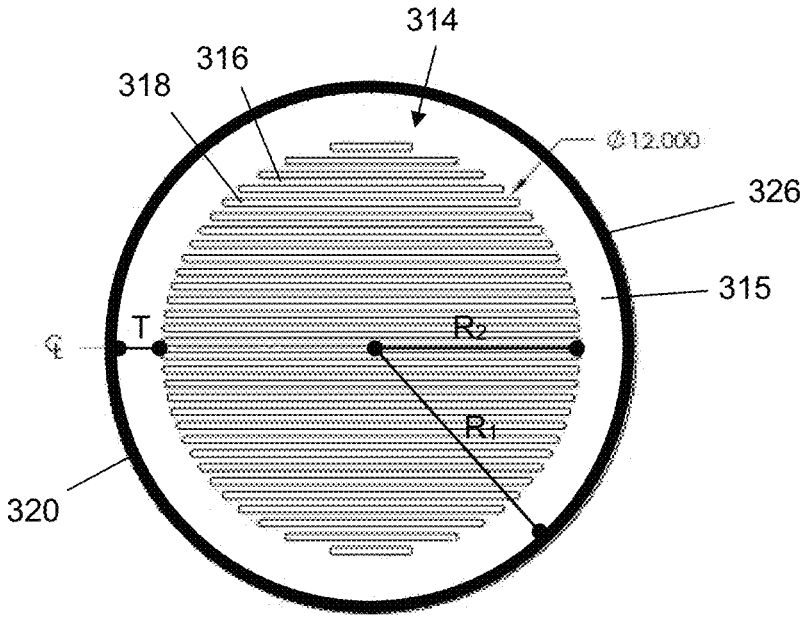
FIG. 10B is a top view of the film snare layer of FIG. 10A installed across a hoop with layer of porous material removed for clarity.

FIG. 10B shows the film layer 314 from FIG. 10A in a standard drumhead assembly installation stretched across a hoop 320, but with the layer of porous material removed for clarity. As depicted, when installed the outer annular portion 315 has a thickness T, the film layer has a radius $R_1$ and the inner portion has a smaller radius $R_2$. Preferably, the film layer radius $R_1$ (which matches the radius of the layer of porous material and the drumhead assembly itself) is within an approximate range of 4 inches to 13 inches, and even more preferably within an approximate range of 5 inches to 9 inches, and even more preferably within an approximate range of 6 inches to 8 inches. The inner portion of the film layer has a radius $R_2$ preferably within an approximate range of 2 inches to 9 inches, more preferably within an approximate range of 4 inches to 8 inches, and even more preferably within an approximate range of 5 inches to 7 inches. Likewise, the outer annular portion 315 can vary in thickness T up to approximately 5 inches, more preferably within an approximate range of 0.1 to 3 inches, and more preferably within an approximate range of 0.25 inches to 1.75 inches, even more preferably within an approximate range of 0.5 inches to 1.5 inches, and even more preferably within an approximate range of 0.75 inches to 1.25 inches. The depicted embodiment is a 14-inch drumhead assembly, so the radius $R_1$ is approximately 7 inches, the inner portion radius $R_2$ is approximately 6 inches and the outer annular portion thickness T is approximately 1.0 inch.

The preferred dimensions shown in FIGS. 10A and 10B and described above are preferred for a 14-inch drumhead assembly 300, but are open to a significant degree of variability in many respects. For example, embodiments exist wherein the slots and segments do not have equal thicknesses and/or wherein each of the segments is not spaced at a common distance from adjacent segments. Additionally, embodiments exist wherein the slots and segments extend over a different area of the film layer, the slots and segments are not centrally located on the film layer and/or are not of uniform thicknesses.

Preferably, the slots 318 and segments 316 extend parallel and have thicknesses within an approximate range of 0.05 inches to 0.5 inches, and more preferably within an approximate range of 0.1 inches to 0.3 inches. More preferably, as in the embodiment shown in FIG. 10, each of the slots and segments is approximately 0.2 inches thick. As noted above, each slot and each segment may have the same thickness as other slots and/or other segments or may have differing dimensions from other slots and segments.

In a preferred embodiment, a flat sheet of film material is laser cut to the desired specifications, which include the predetermined configuration of holes and slots to yield the preferred configuration of film segments, like those shown as reference numerals 214 and 314. Another method of forming the film layer 214 or 314 is via die cutting of a sheet of an appropriate film material. The film material can be made from the same material as a standard drum membrane, such as Kevlar® or Mylar® branded polymers, polyesters, aramids or other polymeric materials. The material may take the form of mono- or multi-filament mesh and/or may be a woven material.

The porous layer 212 or 312 can be formed of any suitable material or fabric with pores that allow air to flow from the exterior to the interior of the drum when the drumhead 210 or 310 is struck. For example, polymer filaments or meshes with variable pore sizes can be employed. Further, the size of the pores can be adjusted via stretching of the material layer 212 or 312 across the hoop 220 or 320. The mesh may be formed of monofilament or multifilament materials in woven, twisted, knotted, knit and/or braided configurations to form a porous mesh fabric. Additionally, while the depicted preferred embodiments of the drumhead 200 and 300 include a single layer of porous material and a single film layer, additional plies may be included in any relative layered position on the drumhead to alter acoustic properties and/or feel. Another similar embodiment exists that utilizes a single integral layer formed as a composite between two or more different individual materials or fibers. The porous layer or layers are not limited in terms of a specific orientation of fibers. Exemplary materials for forming the mesh layer include KEVLAR® brand and related aramid synthetic fibers, PEEK and other materials with similar properties. This list of materials is non-limiting to the inventive scope of the disclosure.

In an alternate method of assembling a drumhead like those shown as reference numerals 200 and 300, once the film layer 214/314 is cut to its specifications, it is taped in place on the porous layer 212/312, and then permanently affixed to the porous layer in places with adhesive in a manner that allows vibration between segments 216/316 of the film layer and the porous layer 212/312. For example, portions of the outer annular ring 315 may be fixed to the porous layer 312, while the segments 316 remain unattached and able to vibrate against the porous material. Other attachment techniques may be employed in place of or in addition to adhesive attachment to join the film layer and the porous mesh. Additionally, as described above with respect to the film snare unit 10 and 100, the film unit may actually be attached to an external element, such as the rim of a drum, the hoop of the drumhead or another portion of the drum itself, rather than attached directly to the porous material.

Additional finishing techniques may be employed as known in the drumhead manufacturing field, such as, for example, heat treatment and/or application of coating(s) to assist optimal tone formation. In use, the segments 216/316 of the film layer 214/314 vibrate against the underside of the porous layer 212/312 when the drumhead 200/300 is struck, thereby producing a snare-like sound at a reduced volume relative to a standard snare drum.

The exact dimensions and other configurations of the film layer 214/314 can be adjusted as desired for different sized drumheads or to effect different acoustic properties. Embodiments exist wherein the film layer has a corrugated or waved surface contour like within the snare unit shown in FIG. 5 as reference numeral 100. Altogether, the segments 216/316 and/or holes/slots 218/318 can be varied in size, shape, thickness and/or distance between each other as may be desired. Essentially, the film layer can easily be altered in any number of ways simply by varying the laser or die cutting programming to achieve various acoustic properties.

Preferably, when struck, the reduced volume drumhead 200/300 exhibits a significant reduction in sound pressure level (SPL) compared to a traditional snare drum having the same dimensions, for example, the depicted 14-inch drumhead 200/300 compared to a 14-inch traditional snare drum. Embodiments of the drumhead 200/300 exhibit a reduction in SPL of at least approximately 50% compared to a traditional snare drum of the same dimension, more preferably at least approximately 60%, and even more preferably at least approximately 70% SPL reduction. In a particularly preferred embodiment, SPL is reduced by approximately 80-90% compared to a traditional snare drum of the same dimension.

Further, the reduced volume drumhead 200/300 has been shown to reduce sound level by at least approximately 5 dB, and more preferably by at least 10 dB compared to a standard snare drum of the same dimension. A drumhead like that depicted in the Figures has shown reduction in sound level relative to a traditional snare drum of the same size within an approximate range of 5-25 dB, preferably a reduction within an approximate range of 10-20 dB.

The below example is offered for illustrative purposes to show the efficacy of the disclosed reduced volume snare drumhead 200/300 and does not serve to limit scope of the inventive embodiments disclosed herein.

Example

Sound characteristic measurements were taken to compare a representative reduced-volume drumhead like that shown in FIGS. 8-9 as reference numeral 300 with a 14-inch diameter ("RVSD") to a standard acoustic snare drum with 14-inch diameter ("acoustic"). The data presented in Table 1 below was gathered from sound studies in a semi-anechoic studio environment at a distance of 6 feet and a height of 5 feet from the ground with a dBA weighted decibel reader (dBA calculated with reference sound pressure $p_0$=20 μPa).

TABLE 1

Comparative Sound Data for Reduced Volume Snare

| dB acoustic | dB RVSD | SPL acoustic | SPL RVSD | SPL reduction (%) |
|---|---|---|---|---|
| 96 | 79 | 1.262 | 0.178 | 85.9% |

As reflected in the data of Table 1, the reduced volume drumhead 300 reduces sound level by 17 dB and SPL by 85.9% under the testing conditions summarized above, while maintaining tonal characteristics consistent with a traditional snare drum. The sound characteristics associated with the drumhead 300 are recognized and viewed as being sufficiently audible to be usable for performance in lower volume settings. Further, musicians report an authentic snare-like acoustic tone and a more natural feel when striking the drumhead.

Altogether, the embodiments of the drumhead 200/300 and related snare unit 10/100 show remarkable efficacy in providing solutions existing problems associated with low volume drumheads that are viewed as being too quiet for many settings and standard snare drums that are viewed as being too loud for other settings. The disclosed embodiments provide an intermediate reduced volume snare drumhead with a synthetic snare unit that provides a natural snare sound at a volume that is lower than standard volume, but more audible than low volume and suitable for performance settings. The drumhead and snare unit are additionally exceedingly durable, lightweight, easily transportable, and resistant to moisture, as compared to products known in the musical instrument arts.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A drumhead, comprising:

a layer of a porous material defining a top surface and bottom surface; and a layer of a film material defining a surface in surface-to-surface contact with one of the top surface or bottom surface of the layer of porous material, wherein the layer of film material is configured and attached to the drumhead such that a portion of the film material vibrates against the porous material when the drumhead is struck, thereby producing a snare-like sound.

2. The drumhead of claim 1, wherein the film layer includes a plurality of slots forming segments therebetween and the segments vibrate against the porous material when the drumhead is struck.

3. The drumhead of claim 1, wherein the layer of film material is a polymer.

4. The drumhead of claim 3, wherein the film material is made from a material selected from the group consisting of Kevlar® or Mylar® branded polymers, polyesters, aramids and other polymeric materials.

5. The drumhead of claim 1, wherein the film material is formed from one or more of a monofilament and a multi-filament material.

6. The drumhead of claim 2, wherein each of the segments in the film layer has a respective thickness dimension and the thickness dimension of each segment is substantially commensurate to one another.

7. The drumhead of claim 2, wherein each of the segments in the film layer has a respective thickness dimension and at least two segments differ from each other in their relative thickness dimensions.

8. The drumhead of claim 2, wherein each of the slots in the film layer has a respective thickness dimension and the thickness dimension of each slot is substantially commensurate to one another.

9. The drumhead of claim 2, wherein each of the slots in the film layer has a respective thickness dimension and at least two slots differ from each other in their relative thickness dimensions.

10. The drumhead of claim 2, wherein one or more of the segments in the film layer has a corrugated surface contour.

11. The drumhead of claim 2, wherein the slots and segments in the film layer extend substantially parallel to one another.

12. The drumhead of claim 2, wherein the layer of porous material and the layer of film are circular, coaxial to one another, and commensurate in peripheral size, the film layer defines a radially inner section circumscribed by an outer circumferential section, the slots segments are positioned within the radially inner section, and the radially outer portion is solid.

13. The drumhead of claim 12, wherein the film layer has a radius of $R_1$, the outer portion has a radial thickness T, and the ratio of $R_1$:T is within an approximate range of between 4:1 and 10:1.

14. The drumhead of claim 13, wherein $R_1$ is within an approximate range of 4 inches to 10 inches and the ratio of $R_1$:T is within an approximate range of between 4:1 and 10:1.

15. The drumhead of claim 1, wherein upon striking the drumhead, the drumhead exhibits a reduction in sound pressure level (SPL) within an approximate range of 50-95% relative to a traditional snare drum of a common size.

16. A snare unit for use with a drumhead, comprising:

a substantially flat sheet of film material having a top surface and opposite bottom surface and comprising a snare section with a plurality of slots from the top surface to the bottom surface, the slots being spaced from one another to form a plurality of snare segments between adjacent slots, wherein the flat sheet of film material is connectable relative to the drumhead in a position with the top surface or bottom surface flat against a surface of the drumhead such that one or more of the segments vibrates against the drumhead when the drumhead is struck, thereby producing a snare-like sound.

17. The snare unit of claim 16, wherein the slots are substantially linear and parallel to one another, thereby defining parallel substantially linear segments.

18. The snare unit of claim 16, wherein the sheet of film material is made from a material selected from the group consisting of Kevlar® or Mylar® branded polymers, polyesters, aramids and other polymeric materials.

19. A drumhead, comprising:

a layer of a porous material defining a top surface and bottom surface; and a layer of a film material defining a surface in surface-to-surface contact with one of the top surface or bottom surface of the layer of porous material, the layer of film material having at least a portion with segments separated from one another by slots, wherein the layer of film material is secured to the layer of porous material at an area of the layer of film material removed from the segments, such that the segments are configured to vibrate freely against the layer of porous material when the drumhead is struck, thereby producing a snare-like sound.

20. The drumhead of claim 19, wherein the segments are positioned at a radially central location in the layer of film material and circumscribed by an annular outer portion, and the layer of film material is secured to the layer of porous material at the annular outer portion.

* * * * *